United States Patent [19]

Moskowitz

[11] 3,977,613

[45] Aug. 31, 1976

[54] GRINDING DISKS

[75] Inventor: Paul M. Moskowitz, Brooklyn, N.Y.

[73] Assignee: Salton, Inc., Bronx, N.Y.

[22] Filed: June 9, 1975

[21] Appl. No.: 585,378

[52] U.S. Cl. ..... 241/261.3; 241/296

[51] Int. Cl.[2] ..... B02C 7/08; B02C 7/12

[58] Field of Search ..... 241/152 A, 155, 157, 241/161–163, 261.2, 261.3, 296

[56] References Cited

UNITED STATES PATENTS

| | | | |
|---|---|---|---|
| 3,761,027 | 9/1973 | Mendoza | 241/261.3 |
| 3,815,834 | 6/1974 | Gilbert | 241/296 X |
| 3,880,367 | 4/1975 | Grover | 241/296 X |
| 3,910,511 | 10/1975 | Leider et al. | 241/261.3 X |

FOREIGN PATENTS OR APPLICATIONS

| | | | |
|---|---|---|---|
| 883,554 | 10/1971 | Canada | 241/296 |

*Primary Examiner*—Granville Y. Custer, Jr.
*Assistant Examiner*—Howard N. Goldberg
*Attorney, Agent, or Firm*—Edward D. O'Brian

[57] ABSTRACT

A set of grinding disks primarily intended for use in grinding nuts such as peanuts in making nut butter can be constructed so as to have adjacent peripheral ring-shaped grinding surfaces located internally of the peripheral walls of such disks. The interiors of such disks within these grinding surfaces are recessed through the use of internally sloping walls to be spaced from one another. The surfaces are each provided with a plurality of spaced grooves leading from the interiors of these surfaces to the exteriors of these surfaces. Projections extend toward the interiors of the disks from the interiors of the grinding surfaces. These projections are constructed so as to convey material which is centrally located between these disks toward the grooves and the grinding surfaces and for comminuting such material as it is conveyed.

8 Claims, 7 Drawing Figures

GRINDING DISKS

CROSS-REFERENCE TO RELATED APPLICATIONS

This application discloses and claims grinding disks which are particularly suitable for use in grinding apparatuses as are set forth in the Brown, et al. U.S. Pat. application Ser. No. 585,379 filed June 9, 1975 entitled "GRINDING APPARATUSES".

BACKGROUND OF THE INVENTION

The invention set forth in this specification pertains to new and improved grinding disks or wheels which are primarily intended for use in grinding nuts in the manufacture of nut butters, but which are considered to be capable of other utilities.

Grinding disks or wheels have been utilized for centuries in grinding many different types of materials. For a great many years it has been conventional to grind vegetable products such as grains, nuts, or the like, by introducing such products into a centrally located opening in a single wheel of a set of so-called "mill" wheels while supplying mechanical power to at least one of such wheels to cause relative motion between such wheels. In conventional grinding wheels the material so located passes outwardly between grooves as at least one of the wheels noted is rotated. Grinding wheels of this type have been proved by prolonged experience to be quite desirable and utilitarian.

However, several problems have been encountered in attempting to utilize grinding wheels of the generalized type indicated in the preceding discussion in connection with the production of nut butters from nuts such as peanuts in small sized grinding apparatuses which are primarily intended for domestic or home type use. For economic reasons it was desired to utilize in such apparatuses comparatively small-sized electric motors having a shaft speed which was considerably greater than the speed of rotation conventionally used with many types of mill and similar wheels. Further, for economic reasons it was considered desirable to have the power output rating of such a motor as small as possible.

One of the problems encountered concerns the nuts which were introduced between a set of grinding wheels, one of which was held stationary and the other of which was rotated by a directly coupled motor as indicated being ejected out through the feed opening used to introduce these nuts into the space between the wheels. Another problem encountered concerns the operability of the grinding disks with various different types of nuts. It was determined that a more or less conventionally constructed set of grinding disks or wheels could not be expected to function satisfactorily with various nuts of the same type such as dry peanuts, oily peanuts and both large and small peanuts. Under certain conditions it was considered that the wheels used might tend to gum up and to stall out the motor employed. Under certain conditions it was found that nuts would not move outwardly through the space between the grinding wheels.

BRIEF SUMMARY OF THE INVENTION

As a result of encountering the problems noted in the preceding it was determined that there existed a need for new and improved grinding disks or wheels. A broad objective of the invention is to provide grinding disks or wheels fulfilling this need. A more specific objective of the invention is to provide grinding disks or wheels which can be utilized to make nut butter out of a wide variety of different nuts having different oil contents and different sizes. A further objective of the invention is to provide grinding disks as described which can be operated satisfactorily with at least one of such disks being rotated at the normal operating speed of a conventional electric motor having a comparatively low power output. A further objective of the present invention is to provide grinding disks having the utility indicated which may be easily and conveniently constructed at a comparatively nominal cost.

In accordance with this invention these objectives are achieved by providing in a set of grinding disks, these disks having peripheral walls and ring-shaped peripheral grinding surfaces spaced internally from these peripheral walls, these surfaces being located adjacent to one another, one of these disks having an opening extending through it for the introduction of material to be ground between the disks, this opening being centrally located in this one of the disks, the improvement which comprises: the interiors of these disks within the grinding surfaces being recessed so as to be spaced from one another, these surfaces being flat surfaces having a plurality of spaced grooves located therein, these grooves leading across the grinding surfaces from the interiors thereof to the exteriors thereof and projection means extending toward the interiors of the disks from the interiors of the grinding surfaces for conveying material from between the grinding disks toward the grooves and the surfaces for comminuting such material as it is conveyed.

BRIEF DESCRIPTION OF THE DRAWING

Further details of the invention are best indicated with reference to the accompanying drawing in which.

Figure 2:
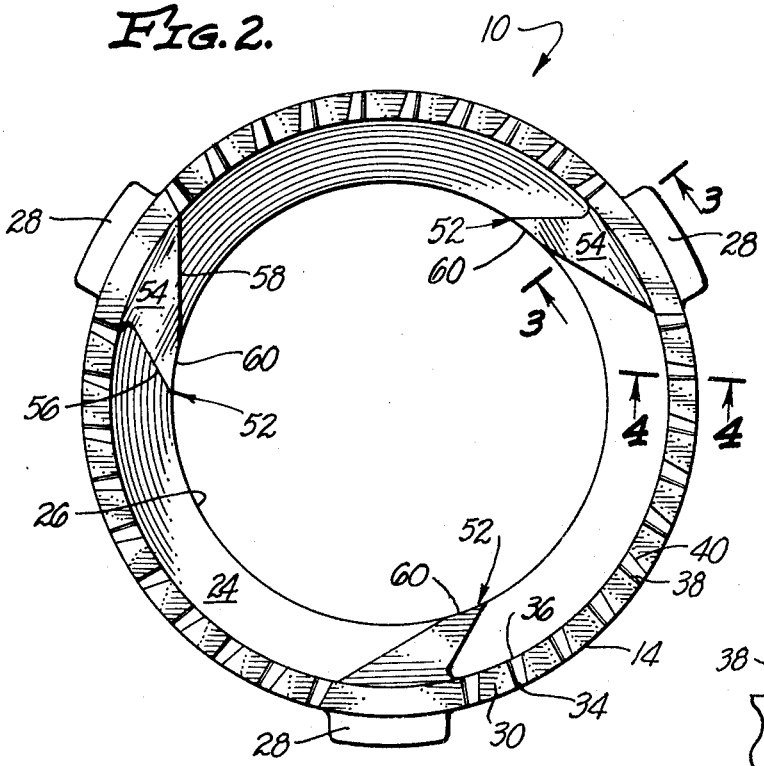
FIG. 2 is a bottom elevational view at an enlarged scale of one of the disks illustrated in FIG. 1.
Figure 3:
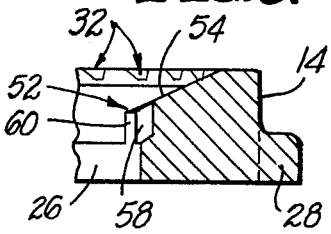
FIG. 3 is a partial cross-sectional view at an enlarged scale taken at line 3—3 of FIG. 2.
Figure 4:
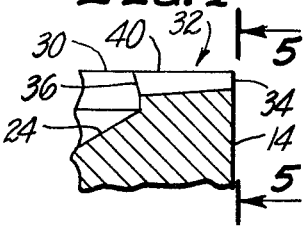
FIG. 4 is a partial cross-sectional view at an enlarged scale taken at line 4—4 of FIG. 2.
Figure 5:
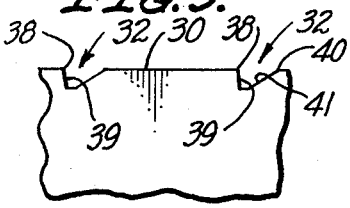
FIG. 5 is a spread out view at an enlarged scale showing a part of the periphery of the disk shown in FIG. 2.

The set of grinding disks illustrated in the drawing embody the concepts or principles set forth in the appended claims. It will be realized that these concepts or principles can be embodied within somewhat differently appearing and differently constructed modified grinding disks through the use of exercise of routine engineering skill.

DETAILED DESCRIPTION

In the drawing there is shown upper and lower grinding disks or wheels 10 and 12, respectively, constructed in accordance with this invention. These disks 10 and 12 constitute a "set" of grinding disks. These disks 10 and 12 are constructed out of a "hard" composition enabling them to withstand the normal abrasion expected during their use in grinding materials such as various nuts. It is considered important that these disks 10 and 12 are shaped in such a manner as to accomplish effective grinding and in such a manner that they can be conveniently manufactured at a comparatively nominal cost by known techniques out of an abrasive, resistant metal or similar composition which will not deteriorate during use.

These disks 10 and 12 are both cylindrical in shape and both have outer or peripheral cylindrical walls 14. The disk 12 also includes a sloping conical wall 16 leading from adjacent to its outer wall 14 to a generally flat bottom 18. This bottom 18 is provided with a centrally located opening 20 which is adapted to be secured to a shaft 22 used to rotate the disk 12 about its axis. As opposed to this the upper disk 10 is constructed so as to have a conical wall 24 corresponding to the wall 16 leading to a centrally located cylindrical opening 26 which is concentric with its wall 14. Further, the upper disk 10 is preferably provided with outwardly extending lugs 28 on its walls 14 which are adapted to be used in mounting this disk 10.

Both the disk 10 and disk 12 are provided with flat, opposed, circular, ring-shaped surfaces 30 leading between the walls 14 and the conical walls 16 and 24 of these disks 10 and 12, respectively. These surfaces 30 are of the same dimension and preferably are as smooth as it is reasonably possible to make them without resorting to lapping or similar techniques. These surfaces 30 are both provided with an equal number of spaced grooves 32, each of which is of a tapered configuration so as to have its smallest end 34 adjacent to a wall 14 and its largest end 36 intersecting a conical wall 16 or 24. For satisfactory operation it is considered that the surface areas of the grooves 32 should be less than the uninterrupted surface areas of the surfaces 30.

Further, these grooves 32 are preferably formed so as to have edges 38 on nearly vertical walls 39 which are substantially radial relative to the axes of the disks 10 and 12 and other edges 40 on sloping walls 41 which are slanted so as to be tangential to imaginary circles (not illustrated) of considerably less diameter than the disks 10 and 12. In cross-section these grooves 32 are of an unsymmetrical V-shape as shown. These edges 40 are located with respect to the directions of rotation employed with the disks 10 and 12 so as to achieve an action as herein described.

Figure 6:
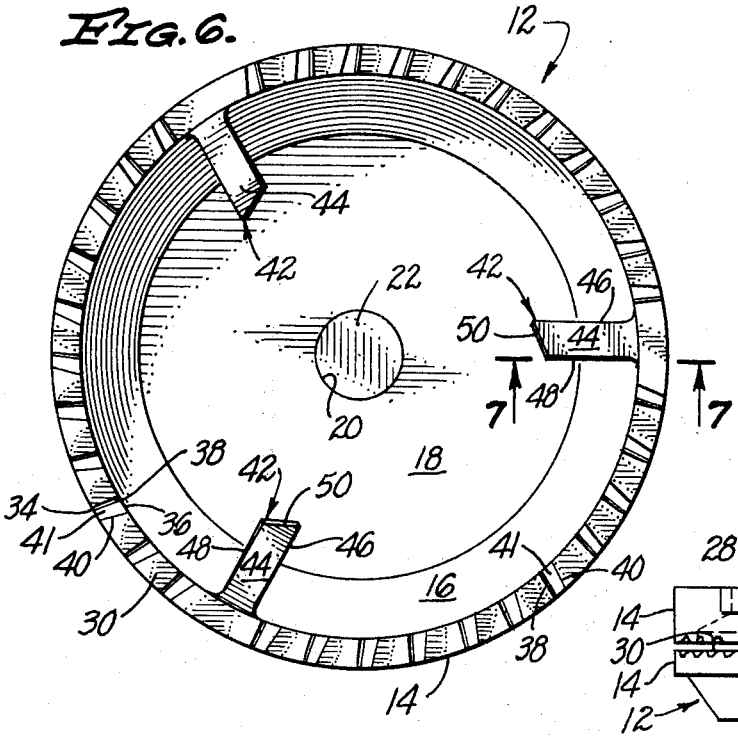
FIG. 6 is a top plan view at an enlarged scale of the other of the disks shown in FIG. 1.
Figure 7:
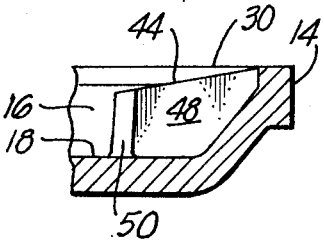
FIG. 7 is a partial cross-sectional view at an enlarged scale taken at line 7—7 of FIG. 6.
Figure 1:
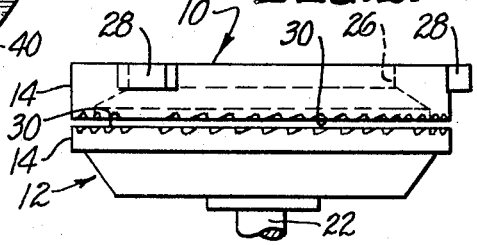
FIG. 1 is a side elevational view of a set of presently preferred grinding disks or wheels in accordance with this invention as such disks are located with respect to one another as they are used.

In the preferred manner of utilizing the disks 10 and 12 the disk 10 is held so that it will not rotate while the disk 12 is rotated relative to the disk 10. It is to be understood, however, that both the disks 10 and 12 can be rotated relative to one another in an established manner if desired. The disks 10 and 12 are constructed in such a manner that the disk 12 will normally be rotated counterclockwise as viewed in FIG. 6. Because of this the edges 40 may be regarded as leading edges and the edges 38 may be termed as trailing edges.

During such rotation three identical conveyor and cutter elements 42 on the disk 12 are used to impart movement to and to partially comminute nuts and/or similar materials located in the space (not separately numbered) between the disks 10 and 12 by being introduced into this space through the opening 26. These elements 42 are constructed so as to extend inwardly from the surfaces 30 in a radial direction and so as to extend inwardly from the wall 16 and along a part of the bottom 18.

These elements 42 are constructed so as to have flat sloping surfaces 44 which slope downwardly from the surfaces 30 toward the bottom 18 and parallel leading and trailing sides 46 and 48, respectively. The surfaces 44 and the sides 46 and 48 terminate in flat sloping ends 50 which slope away from the leading sides 46. Thus, with this construction the leading sides 46 are of larger dimension than the trailing sides 48. It is noted that the surfaces 44, the ends 50 and the sides 46 and 48 intersect at "sharp" edges (not separately numbered).

The disk 10 is provided with conveying and cutting elements 52 which are related to the cutter elements 42. These elements 52 are provided with flat lower surfaces 54 which correspond to the surfaces 44 and which lead from the surfaces 30 generally away from the disk 12 toward the interior of the disk 10 and the opening 26. These surfaces 54 are bound by leading and trailing sides 56 and 58, respectively, disposed at angles relative to an imaginary radial line drawn from the center of the disk 10 so as to appear much as saw teeth. These sides 56 and 58 are connected by ends 60 which approximately lie within a circular path having a diameter approximately corresponding to the diameter of the opening 26.

These ends 60 thus do not project into the interior of the opening 26. It will be realized that the elements 52 are entirely supported upon the conical wall 24 of the disk 10 and that they tend to slope "into" the direction of relative rotation resulting from rotation of the disk 12 when the disk 10 is held stable. Also it is noted that the surfaces 50, the ends 60 and the sides 56 and 58 intersect one another at "sharp" edges (not separately numbered).

When there is such relative rotation any material such as nuts placed between the disks 10 and 12 by movement through the opening 26 will hit against the bottom 18 and will tend to be moved outwardly along this bottom 18 as a result of centrifugal force. As such movement occurs such material being ground will tend to contact the elements 42 and 52 so as to move generally between the elements 42 on the bottom disk 12 and the elements 52 on the upper disk 10. As this occurs these elements 42 and 52 will tend to exercise a shattering or shearing type of cutting action which will tend to break up materials such as nuts into comparatively small fragments or pieces.

It is important to note that when the elements 42 and 52 are shaped as indicated that they will not significantly tend to "kick back" materials such as nuts so as to tend to propel them out through the opening 26. It is also important to note that these elements 42 and 52 will not significantly "crush" materials such as nuts. One of their two principal functions is to break up such materials into comparatively small fragments or pieces. These elements 42 and 52 are not intended to and are believed not to accomplish any significant grinding of materials such as nuts so as to release the internal oils and the like from within the cell structures of such materials. This is considered important with the present invention in providing for satisfactory operation of the disks 10 and 12 and in minimizing the power requirements in operating these disks in the intended manner. The latter, of course, is desirable so as to minimize the size of the motor required to drive a shaft such as the shaft 22.

If oils and similar materials were released to any significant extent as a result of the action of the elements 42 and 52 such materials would tend to cause a "gumming up" effect within the interiors (not separately numbered) of the disks 10 and 12. Further, the presence of any significant quantity of a viscous composition such as is obtained by fine grinding of nuts would tend to impede the elements 42 and 52 from exercising a conveying function in the desired manner and would impede the comparatively rapid movement of material generally between these disks 10 and 12.

As there is relative rotation between the disks 10 and 12 as described the elements 42 and 52 will also serve a conveying function tending to guide extremely small particles introduced between the disks 10 and 12 and created through the operations of these elements 42 and 52 generally toward the walls 16 and 24. Such movement will, of course, be aided by centrifugal force. Because of the shape of these walls 16 and 24 these particles will move along them toward the surfaces 30. As they accumulate adjacent to these surfaces 30 there will be a limited abrasive and compressive action between such particles commencing what would be referred to as an intermediate grinding action. This action will result in the formation of some comparatively fine particles and will result in the liberation of minor amounts of oils and the like.

The principal grinding action, however, will be achieved as the partially comminuted and ground material moves toward the surfaces 30. Although some of such material will move directly between the surfaces 30 it is considered that the vast amount of such material will tend to be "picked up" at the ends 36 of the grooves 32 during relative rotation between the disks 10 and 12 so as to be conveyed into these grooves 32. Such material will move along the walls 41 and will tend to accumulate against the walls 39.

As a consequence of such accumulation against the walls 39 some material will tend to move upwardly over the edges 38 to between the surfaces 30. As the pressure buildup against the walls 39 becomes large such pressure buildup will be relieved to a significant extent by material passing out through the ends 34. Because of their shapes the grooves 32 in effect act more or less like cones in which material is compressed as it is moved toward the ends 34. As any material is moved through the grooves 32 and through the ends 34 it is pressed to a significant extent so as to be further "broken down" by pressure to a significant degree as a result of such action. This will of course result in the release of materials such as oils from nuts and the like and reduce the size of particles present. Also during movement through the grooves 32 some abrasion causing further size reduction will occur.

It is considered, however, that the most significant action in breaking down the material being processed with the disks 10 and 12 is a result of material movement as indicated in the preceding up over the edges 38. Such material passing over these edges 38 to between the surfaces 30 will be abraided as a result of the relative rotation between the disks 10 and 12 in much the manner in which material is abraided in a colloid mill. As a consequence of this action such material will be reduced to a relatively smooth paste-like consistency and due to the action of centrifugal force and the pressure of material processed will gradually move material outward from the surfaces 30 where it can be collected along with material passing through the ends 34. When the disks 10 and 12 are operating in this manner what is regarded as a uniform, finely ground product such as various nut butters can be produced from materials such as nuts.

On many occasions it will be desired to obtain nut butters and the like which are not of a uniform consistency and which contain chunks of comparatively coarse ground particles dispersed in a matrix or carrier phase of comparatively finely ground particles and oil or oil like material. The disks 10 and 12 are considered to be particularly desirable in that they can be conveniently utilized to produce such a product. They can be employed for this purpose in several ways. In one manner of operation the disks are operated so that there is relative rotation between these disks while the axes of these disks are located parallel to one another a short distance from one another. In this manner of operation the distance between the axes of the disks will regulate the fineness of the largest ground particles in the product produced. It is normally preferred that the disks always be used so that there is some overlap between the surfaces 30, but it is possible to operate the disks 10 and 12 so that at diametrically opposed points across their peripheries the surfaces 30 do not overlap. The flat character of the surfaces 30 is considered to make the use of the disks 10 and 12 desirable in applications where the axes of these disks are moved relative to one another since these surfaces do not present any protuberances which are apt to interfere with the relative rotation between the disks.

It is also possible to operate the disks 10 and 12 in another manner in which the axes of these disks are canted at a slight angle to one another so as to intersect one another. In this manner of operation when there is relative rotation between the disks 10 and 12 a variation in grinding will be achieved because there will be a high point and a low point between the surfaces 30 at opposed sides of these disks 10 and 12. As a consequence of this a fine grinding action will be achieved where the surfaces 30 are closely adjacent to one another and a coarser grinding action will be achieved where the surfaces 30 are spaced from one another a maximum amount. When the disks 10 and 12 are operated in this mode of operation it is considered that the flat surfaces 30 are desirable since they minimize the possibility of movement of one disk interfering with the movement of the other.

I claim:

1. A set of grinding disks, said disks having peripheral walls and ring-shaped peripheral grinding surfaces spaced internally from said peripheral walls, said surfaces being located adjacent to one another, one of said disks having an opening extending through it for the introduction of material to be ground between said disks, said opening being centrally located in said one of said disks, in which the improvement comprises:

the interiors of said disks within said grinding surfaces being recessed so as to be spaced from one another, said surfaces being flat surfaces having a plurality of spaced grooves located therein, said grooves leading across said grinding surfaces from the interiors thereof to the exteriors thereof, said grooves having an unsymmetrical V-shape, each of said grooves having a substantially vertical, radially extending wall on the side thereof toward which material will move during relative rotation between said desks, and projection means extending toward the interiors of said disks from the interiors of said grinding surfaces for conveying material from between said grinding disks toward said grooves and said surfaces and for comminuting such material as it is conveyed.

2. A set of grinding disks as claimed in claim 1 wherein:

the surface areas of said grooves are less than the uninterrupted areas of said surfaces.

3. A set of grinding disks as claimed in claim 1 wherein:

said grooves are shaped so that the interior ends of said grooves are larger than the exterior ends of said grooves, said grooves being tapered between said ends.

4. A set of grinding disks as set forth in claim 1 wherein:

the surfafce areas of said grooves are less than the uninterrupted areas of said surfaces, said grooves are shaped so that the interior ends of said grooves are larger than the exterior ends of said grooves, said grooves being tapered between said ends.

5. A set of grinding disks as claimed in claim 1 wherein:

said projection means on one of said disks extends radially from the grinding surface on said one of said disks toward the interior of said one of said disks, and said projection means on the other of said disks extends toward the interior of said other of said disks from the grinding surface of said other of said disks at an angle which will cause said angled projection means to "bite" into material during relative rotation between said disks.

6. A set of grinding disks as claimed in claim 1 wherein:

said projection means on said disks have flat sides and ends which intersect one another at edges, and said projection means on said disks slope from the interiors of said grinding surfaces away from one another as they extend toward the interiors of said disks.

7. A set of grinding disks as claimed in claim 1 wherein:

said projection means on one of said disks extends radially from the grinding surface on said one of said disks toward the interior of said one of said disks, and said projection means on the other of said disks extends toward the interior of said other of said disks from the grinding surface of said other of said disks at an angle which will cause said angled projection means to bite into material during relative rotation between said disks, said projection means on said disks have flat sides and ends which intersect one another at edges and said projection means on said disks slope from the interiors of said grinding surfaces away from one another as they extend toward the interiors of said disks.

8. A set of grinding disks as claimed in claim 1 wherein:

the surface areas of said grooves are less than the uninterrupted areas of said surfaces, said grooves are shaped so that the interior ends of said grooves are larger than the exterior ends of said grooves, said grooves being tapered between said ends, said projection means on one of said disks extends radially from the grinding surface on said one of said disks toward the interior of said one of said disks, and said projection means on the other of said disks extend toward the interior of said other of said disks from the grinding surface of said other of said disks at an angle which will cause said angled projection means to bite into material during relative rotation between said disks, said projection means on said disks have flat sides and ends which intersect one another at edges, and said projection means on said disks slope from the interiors of said grinding surfaces away from one another as they extend toward the interiors of said disks.

* * * * *